US007384250B2

(12) United States Patent
Shin et al.

(10) Patent No.: US 7,384,250 B2
(45) Date of Patent: Jun. 10, 2008

(54) OIL DISCHARGE PREVENTING APPARATUS OF SCROLL COMPRESSOR

(75) Inventors: Dong-Koo Shin, Gyeonggi-Do (KR); Cheol-Hwan Kim, Seoul (KR); Yang-Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 1 day.

(21) Appl. No.: 11/250,542

(22) Filed: Oct. 17, 2005

(65) Prior Publication Data

US 2006/0127262 A1 Jun. 15, 2006

(30) Foreign Application Priority Data

Dec. 10, 2004 (KR) ..... 10-2004-0104419

(51) Int. Cl.
*F03C 2/00* (2006.01)
*F04C 18/00* (2006.01)
*F04C 2/00* (2006.01)

(52) U.S. Cl. ..... 418/55.6; 418/55.1; 418/55.5; 418/57; 418/94; 418/151; 184/6.18

(58) Field of Classification Search ..... 418/55.1–55.6, 418/72, 94, 97, 151, 57; 184/6.18
See application file for complete search history.

(56) References Cited

U.S. PATENT DOCUMENTS 4,365,941 A * 12/1982 Tojo et al. ..... 418/55.5
5,439,361 A * 8/1995 Reynolds et al. ..... 418/55.6

FOREIGN PATENT DOCUMENTS

| | | | | |
|---|---|---|---|---|
| CN | 1113295 A | | 12/1995 | |
| JP | 62118088 A | * | 5/1987 | ..... 418/88 |
| JP | 01015481 A | * | 1/1989 | ..... 418/55.6 |
| JP | 01029685 A | * | 1/1989 | ..... 418/55.6 |
| JP | 2002364566 A | * | 12/2002 | |

* cited by examiner

*Primary Examiner*—Theresa Trieu
(74) *Attorney, Agent, or Firm*—Birch, Stewart, Kolasch & Birch, LLP

(57) ABSTRACT

An oil discharge preventing apparatus of a scroll compressor comprises: a balance weight coupled to a rotor of a driving motor so as to offset an unbalance generated when an orbiting scroll performs an orbiting motion by receiving a rotation force of the driving motor; and a lower fixed oil guide fixedly coupled between the balance weight and the rotor, for preventing oil from being spread in a casing and guiding the oil downwardly to a bottom of the casing, whereby an oil leakage to the outside of the casing can be minimized, the number of construction components can be reduced, and assembling processes can be simplified.

13 Claims, 5 Drawing Sheets

OIL DISCHARGE PREVENTING APPARATUS OF SCROLL COMPRESSOR

BACKGROUND OF THE INVENTION

1. Field of the Invention

The present invention relates to a scroll compressor, and particularly, to a an oil discharge preventing apparatus of a scroll compressor capable of reducing the number of components and simplifying assembling processes as well as minimizing an oil leakage to the exterior.

2. Description of the Conventional Art

In general, compressors are such devices for compressing a refrigerant by converting electric energy into kinetic energy. Such compressors construct a refrigeration system.

The compressors are divided into a rotary compressor, a reciprocal compressor, a scroll compressor, and the like, according to a mechanism for compressing a refrigerant.

The scroll compressor compresses the refrigerant by orbiting in a state that two scrolls are engaged with each other. The scroll compressor can be classified into a low pressure type in which the inside of a casing is maintained in a low pressure state (i.e., a suction pressure state), and a high pressure type in which the inside of the casing is maintained in a high pressure state (i.e., a discharge pressure state).

FIG. 1 is a sectional view showing a part of a compressing device of the scroll compressor.

As shown in the drawing, the scroll compressor includes: a casing 10 having a suction pipe 11 and a discharge pipe 12; a main frame fixed into the casing 10; a fixing scroll 30 fixedly-coupled to an upper side of the main frame 20; an orbiting scroll 40 positioned between the fixing scroll 30 and the main frame 20 so as to be engaged with the fixing scroll 30 to thusly orbit; an oldham ring 50 positioned between the orbiting scroll 40 and the main frame 20, for preventing a rotation of the orbiting scroll 40; a driving motor M fixedly-coupled to the casing 10 with a constant interval from the main frame 20, for generating a driving force; and a rotary axis 60 for transferring the driving force of the driving motor M to the orbiting scroll 40.

The suction pipe 11 is connected to an inlet 31 formed in the fixing scroll 30, and the discharge pipe 12 is located at a lower side of the fixing scroll 30. A bottom surface of the casing 10 is filled with oil.

The main frame 20 includes a frame body portion 21 having a particular shape, an axial insertion opening 22 formed in the frame body portion 21 and through which the rotary axis 60 is inserted, and a boss insertion groove 23 formed with an inner diameter greater than that of the axial insertion opening 22, extending upwardly from the axial insertion opening 22.

The fixing scroll 30 includes a body portion 32 formed in a particular shape, a wrap 33 formed at one surface of the body portion 32 in an involute curve having constant thickness and height, a discharge hole 34 formed through the middle of the body portion 32, and an inlet 31 formed at one side of the body portion 32.

The orbiting scroll 40 includes a disc portion 41 having constant thickness and area, a wrap 42 formed at one surface of the disc portion 41 in the involute curve having constant thickness and height, and a boss portion 43 formed in the middle of the other side of the disc portion 41.

The wrap 42 of the orbiting scroll 40 is engaged with the wrap 33 of the fixing scroll 30, and the boss portion 43 thereof is inserted into the boss insertion groove 23 of the main frame 20.

The rotary axis 60 has an eccentric portion 61 therein. One side of the rotary axis 60 is penetratingly inserted into the axial insertion opening 22 of the main frame 20, and thus its eccentric portion 61 is coupled to the boss portion 43 of the orbiting scroll 40.

The driving motor M includes a stator 70 fixed inwardly to the casing 10, and a rotor 80 rotatably coupled to the inside of the stator 70.

The scroll compressor having such construction will be operated as follows.

When power is applied to the scroll compressor, the rotor 80 rotates by interaction between the stator 70 and the rotor 80 constructing the driving motor M. A rotation force of the rotor 80 is then transferred to the orbiting scroll 40 through the rotary axis 60. As the rotation force of the rotary axis 60 is transferred to the orbiting scroll 40, the orbiting scroll 40 which is coupled to the eccentric portion 61 of the rotary axis 60 orbits centered upon an axial center of the rotary axis 60.

While the orbiting scroll 40 is engaged with the fixing scroll 30 to perform an orbiting motion, volumes of a plurality of compression pockets P formed by the wrap 42 of the orbiting scroll 40 and the wrap 33 of the fixing scroll 30 are changed, so as to suck, compress and discharge a refrigerant. At this time, the refrigerant is sucked into the compression pockets P through the suction pipe 11 and the inlet 31. The refrigerant compressed in the compression pockets P is discharged into the casing 10 through the discharge hole 34.

The compressed refrigerant discharged into the casing 10 flows in the casing 10 and circulates a refrigeration system through the discharge pipe 12.

The oil filled in the bottom of the casing 10, on the other hand, is pumped through an oil flow path 62 formed in the rotary axis 60 by the rotation of the rotary axis 60, and thus supplied between components (parts) which generate a relative motion with one another. The oil supplied between the components generating the relative motion with one another is returned to the bottom of the casing 10.

While such scroll compressor is driven, in the process that the oil filled in the bottom of the casing 10 is supplied between the components generating the relative motion and returned to the bottom of the casing 10, some parts of oil flow into the refrigeration system through the discharge pipe 12 together with the compressed refrigerant which flows in the casing 10. As a result, a lack of oil inside the casing may occur, which causes abrasion between components generating the relative motion. In addition, the oil in the casing 10 flows into the refrigeration system, which causes decrease of efficiency of the refrigeration system.

Therefore, it is one of important tasks to restrict the oil in the casing 10 from being leaked to the outside of the casing 10, researches for which have been executed.

As one of structures introduced in such researches and developments, as shown in FIGS. 1 and 2, a cylindrical oil guide 90 is provided at a lower portion of the main frame 20, and the oil guide 90 is fixedly-coupled to the rotor 80 constructing the driving motor by a bolt 100.

The oil guide 90 includes a cylindrical portion 91 having a constant length, and a supporting portion 92 coupled onto the middle of an inner wall of the cylindrical portion 91 with a particular area, and a plurality of penetration holes 93 formed through the supporting portion 92

The oil guide 90 is coupled to the rotor 93 to be fixedly-coupled to a balance weight 110 for maintaining a balance upon rotating. The balance weight 110 is fixed to an upper end ring 81 constructing the rotor 80.

The balance weight 110 includes; a stator 111 formed in a ring shape with particular thickness and width, and of which one part is open; a weight portion 112 extending upwardly to one side of the stator 111 by a particular height; two position fixing holes 113 formed through (penetratingly formed in) the stator 111; and a plurality of screw holes 114 formed in the weight portion 112.

The rotor 80 includes a core 82 having a certain length, and upper end ring 81 and lower end ring (not shown) which are fixed to both side surfaces of the core 82, respectively.

The upper end ring 81 coupled to an upper surface of the core 82 includes a ring porting E1 having particular thickness and width and an outer diameter corresponding to that of the core 82, and fixing protrusions E2 protrudingly extending from one surface of the ring portion E1.

The fixing protrusions E2 of the upper end ring 81 are inserted into the position fixing holes 113 of the balance weight 110, respectively. The balance weight 110 is coupled to the upper end ring 81 of the rotor 80 by caulking ends of the fixing protrusions E2 of the upper end ring 81. The balance weight 110 is inserted into the oil guide 90. The supporting portion 92 of the oil guide 90 is supported on the upper surface of the weight portion 112 of the balance weight 110. Bolts 100 are coupled to the penetration holes 93 of the oil guide 90 and the screw holes 114 of the balance weight 110, respectively. At this time, a lower surface of the oil guide 90 is contact with an upper surface of the upper end ring 81.

Unexplained reference symbol 71 denotes a lamination body, and 72 denotes a coil winding.

An operation of such structure will now be explained.

Parts of oil spread toward the upper end of the rotary axis 60 through the oil flow path 62 of the rotary axis 60 flows downwardly through the boss insertion groove 23 and the axial insertion opening 22. At this time, the oil is spread (shattered) by a centrifugal force of the rotary axis 60. The spread oil is collected by the oil guide 90 and flows downwardly. The oil flowing along the oil guide 90 is returned to the bottom of the casing 10 through an oil flow passage F formed between the rotor 80 and the rotary axis 60. Thus, the oil guide 90 collects the oil spread into the casing to guide the oil to the bottom of the casing 10. As a result, the oil leakage to the outside of the casing 10 together with the refrigerant can be minimized.

However, in such oil discharge preventing apparatus, after the upper end ring 81 of the rotor 80 and the balance weight 110 are coupled to each other by the caulking process, the oil guide 90 and the balance weight 110 are fastened to each other by a plurality of bolts 100, which may cause increase of the number of construction components and complication of assembling process, thereby resulting in increase of fabrication cost and decrease of assembling productivity.

Furthermore, a gap may generated between the oil guide 90 and the upper end ring 81 by processing tolerance or assembling tolerance when the balance weight 110 is coupled to the oil guide 90. The oil may be leaked through the gap to be spread into the casing 10, thereby being leaked to the outside of the casing 10 together with the refrigerant.

On the other hand, in order to remove the gap generated between the oil guide 90 and the upper end ring 81 according to the assembling tolerance or the processing tolerance of the balance weight 110 and the oil guide 90, if the balance weight 110 is formed to be integrated with the oil guide 90, the balance weight 110 and the oil guide 90 are generally fabricated using copper, considering that the balance weight 110 is generally fabricated using the copper. Accordingly, the fabrication cost can be increased.

SUMMARY OF THE INVENTION

Therefore, an object of the present invention is to provide an oil discharge preventing apparatus of a scroll compressor capable of reducing the number of construction components and simplifying assembling processes as well as minimizing an oil leakage to the outside of a casing.

Another object of the present invention, there is provided an oil discharge preventing apparatus of a scroll compressor capable of decreasing fabrication cost.

To achieve these and other advantages and in accordance with the purpose of the present invention, as embodied and broadly described herein, there is provided an oil discharge preventing apparatus of a scroll compressor comprising: a balance weight coupled to a rotor of a driving motor so as to offset an unbalance generated when an orbiting scroll performs an orbiting motion by receiving a rotation force of the driving motor; and an oil guide fixedly coupled between the balance weight and the rotor, for preventing oil from being spread in a casing and guiding the oil downwardly to a bottom of the casing.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to an oil discharge preventing apparatus of a scroll compressor according to the present invention, examples of which are illustrated in the accompanying drawings.

Figure 1:
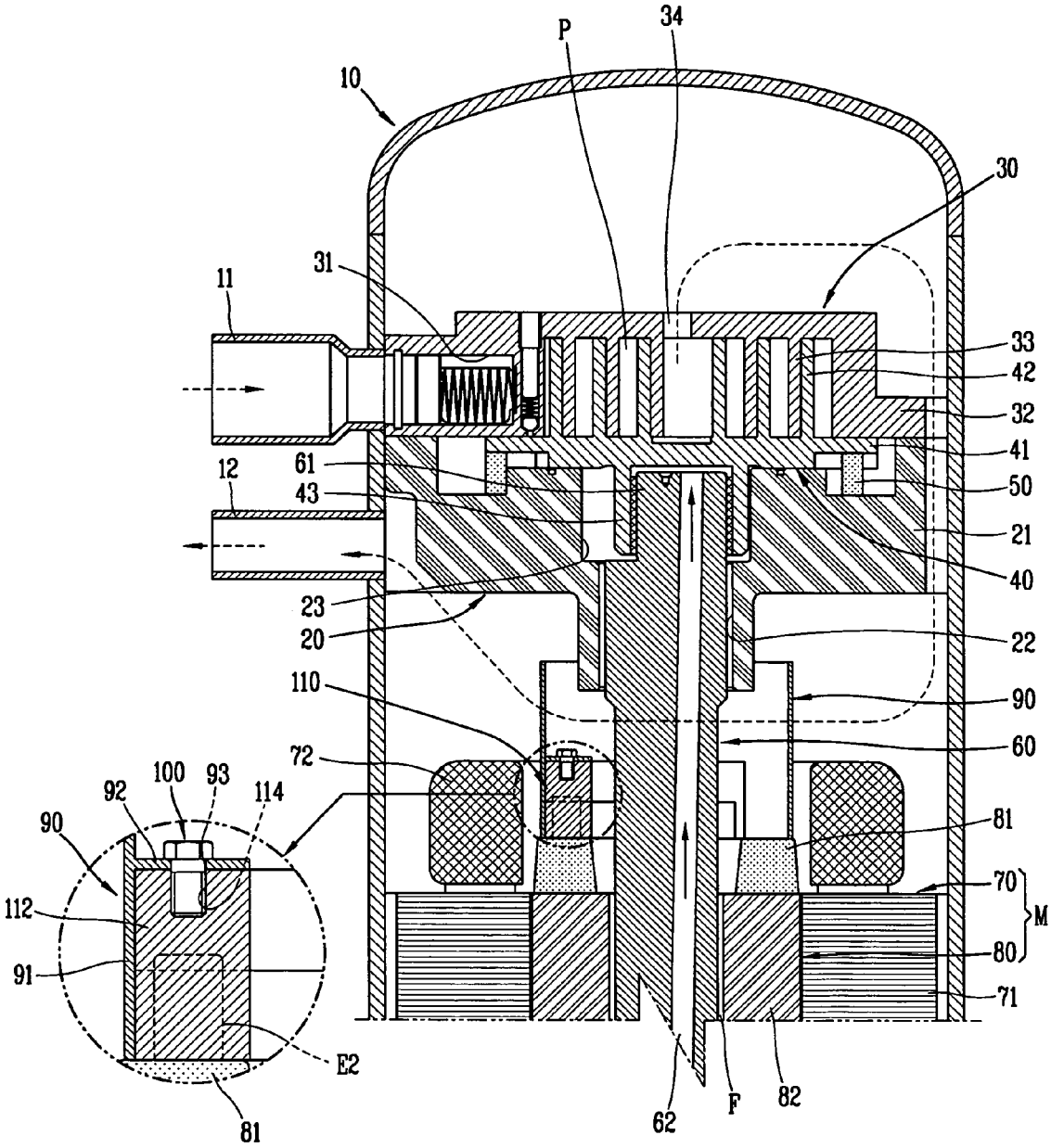
FIG. 1 BACKGROUND ART
FIG. 1 is a sectional view showing a part of a typical scroll compressor.
Figure 2:
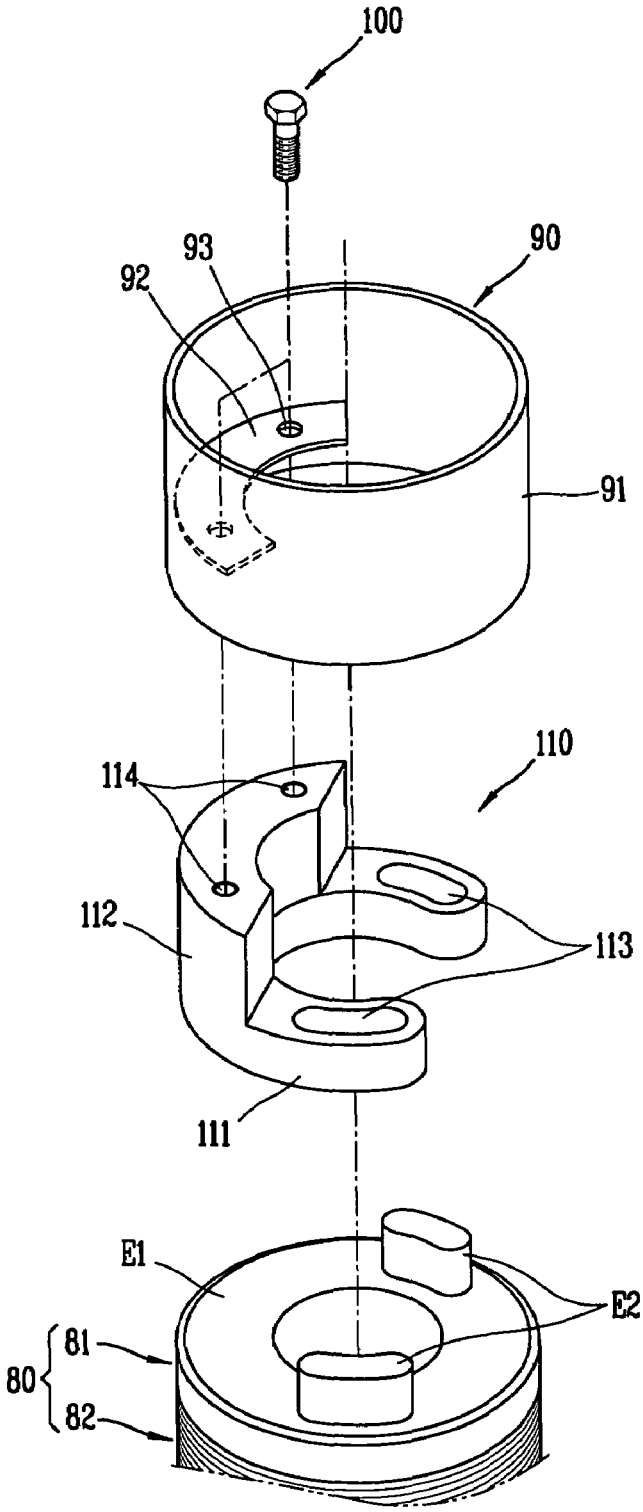
FIG. 2 BACKGROUND ART
FIG. 2 is an exploded perspective view of an oil discharge preventing apparatus constructing the scroll compressor.
Figure 3:
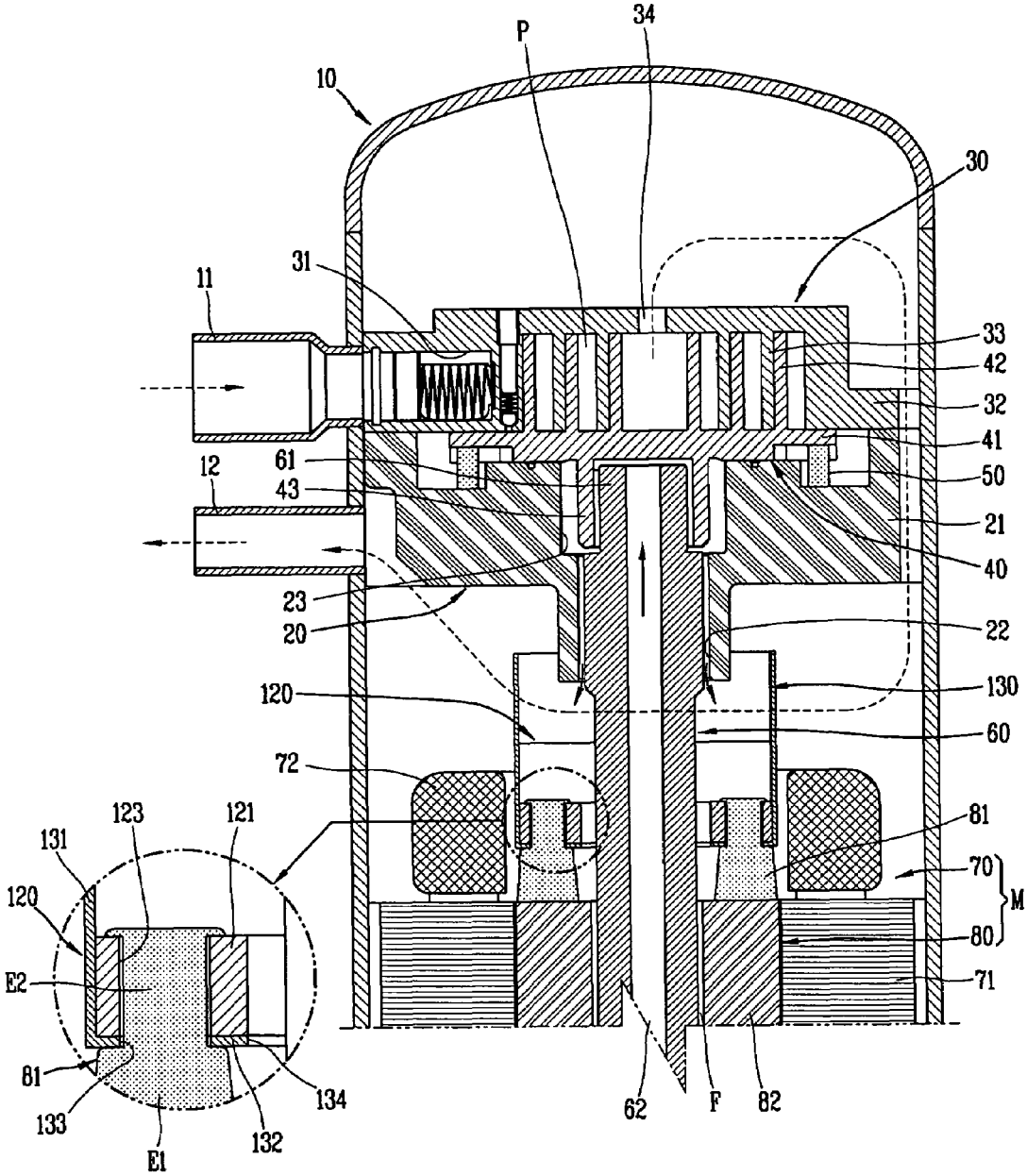
FIG. 3 is a sectional view showing a part of a scroll compressor provided with an embodiment of an oil discharge preventing apparatus according to the present invention.
Figure 4:
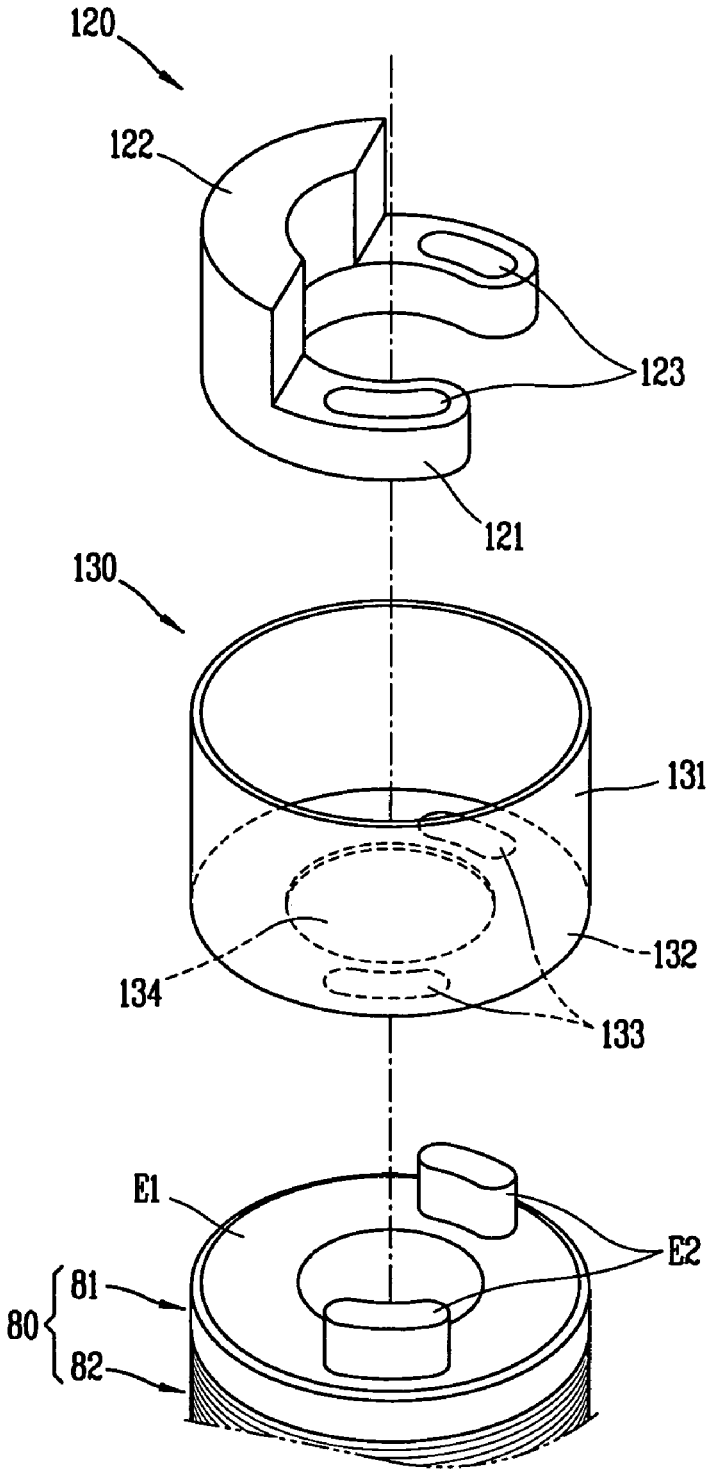
FIG. 4 is an exploded perspective view showing an oil discharge apparatus of a scroll compressor according to the present invention.

FIG. 3 is a sectional view showing a part of a scroll compressor provided with an embodiment of an oil discharge preventing apparatus according to the present invention, and FIG. 4 is a disassembled perspective view showing an oil discharge preventing apparatus of the scroll compressor. The same reference symbols are applied to the same parts as those of the conventional art.

As shown in those drawings, a scroll compressor includes: a casing 10 having a suction pipe 11 and a discharge pipe 12; a main frame fixed into the casing 10; a fixing scroll 30 fixedly-coupled to an upper side of the main frame 20; an orbiting scroll 40 positioned between the fixing scroll 30 and the main frame 20 so as to be engaged with the fixing scroll 30 to thusly orbit; an oldham ring 50 positioned between the orbiting scroll 40 and the main frame 20, for preventing a rotation of the orbiting scroll 40; a driving motor M fixedly-coupled to the casing 10 with a constant interval from the main frame 20, for generating a driving force; and a rotary axis 60 for transferring the driving force of the driving motor M to the orbiting scroll 40.

The casing 10, main frame 20, fixing scroll 30, orbiting scroll 40, oldham ring 50, and rotary axis 60 are the same as those aforementioned, for which detailed explanation will thus be omitted.

The driving motor M includes a stator 70 fixedly coupled into the casing 10, and a rotor 80 rotatably coupled into the stator 70. The stator 70 includes a lamination body 71 formed by laminating a plurality of thin sheets and a coil winding 72 wound on the lamination body 71. The rotor 80 includes a core 82 inserted into the stator 70, and upper end ring 81 and lower end ring (not shown) coupled to both sides of the core 82, respectively. The rotary axis 60 is press-fitted in the core 82. A plurality of oil flow passages F are penetratingly-formed between the rotary axis 60 and the core 82 in an axial direction.

The upper end ring 81 includes a ring portion E1 having particular thickness and width and an outer diameter corresponding to that of the core 81, and fixing protrusions E2 protrudingly extending upwardly from one surface of the ring portion E1 by a particular height. Preferably, two of the fixing protrusions E2 are formed.

A balance weight 120 is coupled to the rotor 80. The balance weight 120 includes a fixing portion 121 formed in a ring shape with particular thickness and width and of which one part is open, a weight portion extending upwardly from one side of the fixing portion 121 by a certain height, and two position fixing holes 123 penetratingly formed in the fixing portion 121. The weight portion 122 is not provided with screw holes as shown in the conventional art.

The balance weight 120 offsets an unbalance generated when the orbiting scroll 40 orbits by receiving a rotation force of the driving motor M.

A lower fixed oil guide 130 is fixedly coupled between the balance weight 120 and the rotor 80. The lower fixed oil guide 130 includes a cylindrical portion 131 having constant length and outer diameter, a coupling plate 132 curvedly-extending inwardly from a bottom of the cylindrical portion 131; and a plurality of coupling holes 133 penetratingly formed in the coupling plate 132. Two coupling holes 133 are provided. The outer diameter of the cylindrical portion 131 is preferably formed to correspond to that of the upper end ring 81. The coupling plate 132 is preferably formed in a ring shape with a constant width, and an inner portion thereof is formed as an oil through hole 134 through which the oil flows.

The balance weight 120 and the lower fixed oil guide 130 are formed of different materials from each other. Preferably, the balance weight 120 is formed of copper, while the lower fixed oil guide 130 is formed of steel.

The balance weight 120 and the lower fixed oil guide 130 are coupled to the upper end ring 81 of the rotor 80.

The structure in which the balance weight 120 and the lower fixed oil guide 130 are coupled to the upper end ring 81 of the rotor 80 will now be described.

Figure 5:
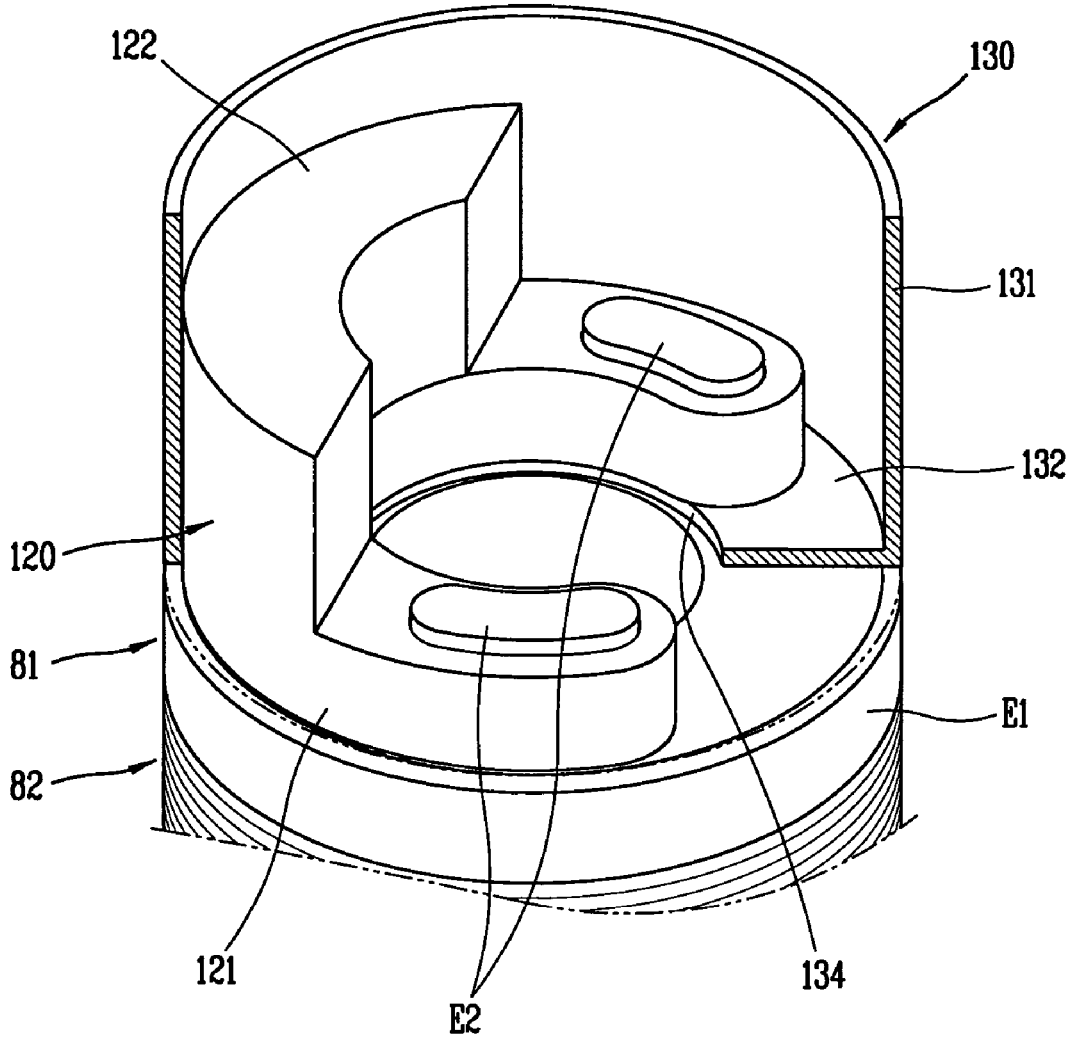
FIG. 5 is a perspective view showing an oil discharge preventing apparatus according to the present invention.

As shown in FIG. 5, first, the fixing protrusions E2 of the upper end ring 81 are inserted into the coupling holes 133 of the lower fixed oil guide 130, respectively. At this time, a lower surface of the coupling plate 132 of the lower fixed oil guide 130 is contact with an upper surface of the upper end ring 81. The fixing protrusions E2 are protruded on the coupling plate 132 of the lower fixed oil guide 130. The balance weight 120 is positioned in the cylindrical portion 131 of the lower fixed oil guide 130, and the fixing protrusions E2 of the upper end ring 81 are inserted into the position fixing holes 123 of the balance weight 120, respectively. At this time, the fixing protrusions E2 are protruded on the fixing portion 121 of the balance weight 120. Ends of the fixing protrusions E2 of the upper end ring 81 are caulked so that the lower fixed oil guide 130 and the balance weight 120 are coupled to the upper end ring 81 of the rotor.

The lower fixed oil guide 130 is positioned below the axial insertion opening 22 of the main frame 20, and covers a part of the rotary axis 60.

Hereinafter, an operation effect of the oil discharge preventing apparatus of the scroll compressor according to the present invention will now be explained.

First, the scroll compressor will be operated as follows.

When power is applied to the scroll compressor, the rotor 80 rotates by interaction between the stator 70 and the rotor 80 constructing the driving motor M. The rotation force of the rotor 80 is transferred to the orbiting scroll 40 through the rotary axis 60. As the rotation force of the rotary axis 60 is transferred to the orbiting scroll 40, the orbiting scroll 40 coupled to the eccentric portion 61 of the rotary axis 60 performs an orbiting motion centered upon an axial center of the rotary axis 60.

As the orbiting scroll 40 orbits, the wrap 42 of the orbiting scroll 40 also performs the orbiting motion by being engaged with the wrap 33 of the fixing scroll 30. Accordingly, volumes of the plurality of compression pockets P formed by the wrap 42 of the orbiting scroll 40 and the wrap 33 of the fixing scroll 30 are changed so as to suck and compress the refrigerant, thereafter discharging the compressed refrigerant through the discharge hole 34 of the fixing scroll 30.

The refrigerant discharged through the discharge hole 34 of the fixing scroll 30 flows in the casing 10, and is discharged to the outside of the casing 10 through the discharge pipe 12 positioned below the fixing scroll 30. At this time, the inside of the casing 10 is maintained in a high pressure state by the compressed refrigerant.

As the rotary axis 60 rotates, on the other side, the oil filled in the bottom of the casing 10 flows upwardly through the oil flow path 62 of the rotary axis 60. While this, the oil is spread to the boss insertion groove 23 of the main frame 20. The oil spread to the boss insertion groove 23 is supplied between components generating a relative motion therewith. The oil flowing through the boss insertion groove 23 and the axial insertion opening 22 is spread (shattered) by the rotation of the rotary axis 60. The spread oil is collected in an inner wall of the lower fixed oil guide 130 and then flows along an inner surface of the lower fixed oil guide 130. The oil flowing along the inner surface of the lower fixed oil guide 130 is returned to the bottom of the casing 10 through the oil flow passages F formed between the rotor 80 and the rotary axis 60 via the oil through hole 134 of the lower fixed oil guide 130.

The lower fixed oil guide 130 collects the spread oil while the oil supplied between the components generating the relative motion therewith flows downwardly through the boss insertion groove 23 and the axial insertion opening 22, and guides the gathered oil downwardly. As a result, a leakage of the oil to the outside of the casing 10 together with the compressed refrigerant can be prevented.

The coupling plate formed at the lower end of the lower fixed oil guide 130 is fixed between the balance weight 120 and the upper end ring 81, and accordingly a gap between the lower fixed oil guide 130 and the upper end ring 81 is not generated, thereby preventing the oil, which is leaked between the lower fixed oil guide 130 and the upper end ring 81, from being spread into the casing 10. Hence, the oil can be prevented from being leaked to the outside of the casing 10 together with the refrigerant through the discharge pipe 12.

Because the lower fixed oil guide 130 is coupled between the balance weight 120 and the rotor 80, separate bolts for fixing the lower fixed oil guide 130 are not used. As a result, the number of construction components to which the lower fixed oil guide is fixedly coupled can be reduced and the assembling processes therefor can be simplified.

In addition, since the balance weight 120 and the lower fixed oil guide 130 are formed of different materials, respectively, cost for the materials can relatively be reduced, comparing with integrally forming the balance weight 120 and the lower fixed oil guide 130 equally using copper.

As described so far, in the oil discharge preventing apparatus of the scroll compressor according to the present invention, by minimizing that the oil filled in the casing is spread to the outside of the casing 10, a lack of oil filled in the casing of the compressor can be prevented, which results in increase of an efficiency of the compressor. The oil can be prevented from flowing into the refrigeration system, which leads to a high efficiency of the refrigeration system.

Also, the number of construction components for preventing the oil leakage can be reduced and the assembling processes can be simplified, and accordingly the fabrication cost can be decreased and an assembling productivity can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An oil discharge preventing apparatus of a scroll compressor, comprising:

a balance weight coupled to a rotor of a driving motor so as to offset an unbalance generated when an orbiting scroll performs an orbiting motion by receiving a rotation force of the driving motor; and a lower fixed oil guide fixedly coupled between the balance weight and the rotor, for preventing oil from being spread in a casing and guiding the oil downwardly to a bottom of the casing.

2. The apparatus of claim 1, wherein the balance weight is received in the lower fixed oil guide.

3. The apparatus of claim 1, wherein the balance weight is fixedly coupled to an upper end ring constructing the rotor.

4. The apparatus of claim 1, wherein the balance weight and the lower fixed oil guide are formed of different materials from each other.

5. The apparatus of claim 1, wherein the lower fixed oil guide includes a coupling plate, the coupling plate being located between the balance weight and the rotor.

6. The apparatus of claim 5, wherein the coupling plate has an oil through hole, the oil being guided through the oil through hole downwardly to the bottom of the casing.

7. The apparatus of claim 5, wherein the coupling plate is located at a bottom side of the lower fixed oil guide.

8. The apparatus of claim 5, wherein the rotor has an upper end ring passing though the coupling plate.

9. The apparatus of claim 8, wherein the coupling plate has at least one coupling hole, the upper end ring passing through the at one coupling hole into the balance weight.

10. An oil discharge preventing apparatus of a scroll compressor, comprising:

a balance weight coupled to a rotor of a driving motor so as to offset an unbalance generated when an orbiting scroll performs an orbiting motion by receiving a rotation force of the driving motor; and a lower fixed oil guide fixedly coupled between the balance weight and the rotor, for preventing oil from being spread in a casing and guiding the oil downwardly to a bottom of the casing, wherein a plurality of fixing protrusions are formed on an upper surface of the rotor, a plurality of coupling holes are formed in a coupling plate curvedly-extending inwardly from a bottom of the lower fixed oil guide so that the fixing protrusions of the rotor are inserted into the coupling holes, respectively, a plurality of position fixing holes are formed in the balance weight so that the fixing protrusions of the rotor are inserted into the position fixing holes of the balance weight, respectively, thereby positioning the balance weight on the coupling plate of the lower fixed oil guide.

11. The apparatus of claim 10, wherein the lower fixed oil guide and the balance weight are fixedly coupled to the rotor by caulking the fixing protrusions of the rotor.

12. An oil discharge preventing apparatus of a scroll compressor, comprising:

a balance weight coupled to a rotor of a driving motor so as to offset an unbalance generated when an orbiting scroll performs an orbiting motion by receiving a rotation force of the driving motor; and a lower fixed oil guide fixedly coupled between the balance weight and the rotor, for preventing oil from being spread in a casing and guiding the oil downwardly to a bottom of the casing, wherein the lower fixed oil guide comprises:

a cylindrical portion having constant length and outer diameter;

a coupling plate curvedly-extending inwardly by a particular area from a bottom of the cylindrical portion; and a plurality of coupling holes formed through the coupling plate.

13. The apparatus of claim 12, wherein an oil through hole penetrated in a length direction of the rotor is formed in the lower fixed oil guide.

* * * * *